US010995595B2

(12) United States Patent
Rabba et al.

(10) Patent No.: US 10,995,595 B2
(45) Date of Patent: May 4, 2021

(54) SYSTEM AND METHOD FOR ARTIFICALLY RECHARGING A TARGET RESERVOIR VIA WATER INJECTION FROM A LOCAL SOURCE

(71) Applicant: Saudi Arabian Oil Company, Dhahran (SA)

(72) Inventors: Ali Saleh Rabba, Dhahran (SA); Sultan Sabri Al-Madani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 97 days.

(21) Appl. No.: 16/266,408

(22) Filed: Feb. 4, 2019

(65) Prior Publication Data

US 2020/0248541 A1 Aug. 6, 2020

(51) Int. Cl.

| | |
|---|---|
| ***E21B 43/16*** | (2006.01) |
| ***E21B 4/04*** | (2006.01) |
| ***E21B 34/06*** | (2006.01) |
| ***E21B 43/12*** | (2006.01) |

(52) U.S. Cl.

CPC ..... *E21B 43/162* (2013.01); *E21B 4/04* (2013.01); *E21B 34/066* (2013.01); *E21B 43/128* (2013.01)

(58) Field of Classification Search

CPC ..... E21B 43/00; E21B 47/11; E21B 49/00; E21B 21/065; E21B 49/003

See application file for complete search history.

(56) References Cited

U.S. PATENT DOCUMENTS

| | | | | |
|---|---|---|---|---|
| 8,365,819 | B2 | 2/2013 | Murphy et al. | |
| 9,810,049 | B2 | 11/2017 | Dean et al. | |
| 10,012,551 | B2 | 7/2018 | Smith et al. | |
| 2010/0284828 | A1 | 11/2010 | Woie et al. | |
| 2015/0159472 | A1 | 6/2015 | Wolf et al. | |
| 2019/0334412 | A1* | 10/2019 | Franck | F03B 13/00 |
| 2020/0131744 | A1* | 4/2020 | Hunt | E03B 7/071 |

OTHER PUBLICATIONS

Baker Hughes, "Dump Flood Operation Using an Inverted ESP Mitigates Cost of Drilling a Water Injection Well System, Enhances Productivity", Baker Hughes Incorporated, 2015, Company technical brochure.

(Continued)

*Primary Examiner* — Zakiya W Bates
(74) *Attorney, Agent, or Firm* — Leason Ellis LLP

(57) ABSTRACT

A method for artificially recharging a target reservoir in a geological formation using powered water injection from a local source aquifer in the geological formation. The method comprises detecting chemical properties of water in the source aquifer, determining whether the water in the source aquifer is compatible with water in the target reservoir based on the chemical properties, activating an electrical submersible pump (ESP) positioned between target reservoir and the source aquifer to inject water from the source aquifer into the target reservoir, detecting downhole pressure, temperature and water flow rate conditions at the ESP, and controlling a rate at which the ESP injects water using the downhole pressure, temperature and water flow rate conditions.

17 Claims, 4 Drawing Sheets

(56) References Cited

OTHER PUBLICATIONS

Borets Company, "Selective Injection Technology", Company technical brochure, 5, Moldavskaya st., Moscow, 121467, Russia, 2015.
Ahmed El-Shafey, "Power injection with Zenith™ ESP bypass boosts field development & production"; GEA32568, GE Oil & Gas & Qarun Petroleum Company, 2016.
Technical Catalogue, "A-ESP-V water injection pumping system", Water Injection Systems, Equipment for Oil Production, Retrieved from the Internet: www.rimera.com/upload/catalog/pdf/ALNAS-ENG-169.pdf , [retrieved on Feb. 4, 2019].
Jokhio, S. A., M. R. Berry, and Y. K. Bangash. "DOWS (Downhole Oil-Water Separation) Cross-Waterflood Economics." SPE/DOE Improved Oil Recovery Symposium. Society of Petroleum Engineers, 2002. 10 pages.
Devia, Néstor, et al. "Improving Oil Recovery in Mature Field With Innovative Completion Solution Dumpflood Application." SPE Latin America and Caribbean Mature Fields Symposium. Society of Petroleum Engineers, 2017. 8 pages.
International Search Report and Written Opinion in Corresponding Patent Application No. PCT/US2020/016343 dated May 20, 2020. 14 pages.

* cited by examiner

SYSTEM AND METHOD FOR ARTIFICIALLY RECHARGING A TARGET RESERVOIR VIA WATER INJECTION FROM A LOCAL SOURCE

FIELD OF THE INVENTION

The present invention relates to oil and gas extraction, and, more particularly, relates to a system and method for artificially recharging a target reservoir by water injection from a local source.

BACKGROUND OF THE INVENTION

As oil and gas reservoir are depleted, the internal fluid pressure (reservoir pressure) required to force gas and liquids to the service typically falls. Some reservoirs have natural influx from water aquifers that help maintain the reservoir pressure during production and the associated pressure decline. For reservoirs that lack natural aquifer support, external water injection can be used to maintain the reservoir pressure. Reliance on external water injection is problematic in remote satellite fields (i.e., reservoirs remote from main production installations) as it can be challenging and costly to connect the remote fields to central water injection facilities. Additionally, external water injection typically requires additional installations in the main field facility as well as detailed field and lab studies.

It would therefore be advantageous to provide a system and method of providing self-feeding water injection at remote satellite fields that does not rely upon external, remote water sources.

SUMMARY OF THE INVENTION

Embodiments of the present invention provide a method for artificially recharging a target reservoir in a geological formation using powered water injection from a local source aquifer in the geological formation. The method comprises detecting chemical properties of water in the source aquifer, determining whether the water in the source aquifer is compatible with water in the target reservoir based on the chemical properties, activating an electrical submersible pump (ESP) positioned between target reservoir and the source aquifer to inject water from the source aquifer into the target reservoir, detecting downhole pressure, temperature and water flow rate conditions at the ESP, and controlling a rate at which the ESP injects water using the downhole pressure, temperature and water flow rate conditions.

In certain implementations, the ESP is a centrifugal pump and the rate at which the ESP injects water is controlled by a variable speed drive.

Some embodiments of the method further comprise steps of determining from the detected downhole pressure, temperature and water flow rate whether a potentially harmful condition is present and shutting down the ESP if it is determined that a potentially harmful condition is present.

The ESP can be positioned in a bore hole that extends to the target reservoir and source aquifer and a control valve is positioned in the bore hole between the source aquifer and target reservoir. In some implementations, the control valve is closed if is determined that a potentially harmful condition is present.

Embodiments of the present invention also provide a system for artificially recharging a target reservoir in a geological formation using powered water injection from a local source aquifer in the geological formation. The system comprises an electrical submersible pump (ESP) positioned between the target reservoir and the source aquifer, the ESP including a pump and a plurality of sensors, the plurality of sensors having a chemical sensor adapted to detect chemical properties of water in the source aquifer, and at least one downhole condition sensor, and an electronic controller electrically coupled to the electrically submersible pump configured to receive data from plurality of sensors, to determine whether the water in the source aquifer is compatible with water in the target reservoir, and to activate the pump to inject water from the source aquifer into the target reservoir when the water in the source aquifer is compatible with water in the target reservoir, and downhole conditions are amenable for water injection.

In certain embodiments, the system further comprises a cable conduit positioned in a bore hole connecting the target reservoir and the source aquifer, the ESP being positioned in the cable conduit, the cable conduit having wall perforations permitting water to exit the conduit into the target reservoir. In certain implementations, a control valve positioned in the cable conduit between the source aquifer and the target reservoir electrically coupled to and re responsive to control signals from the electronic controller.

The at least one downhole sensor can include a pressure sensor, a temperature sensor and a water flow meter. The electronic controller can be configured to shut down the pump of the ESP and the control value if data received from the pressure, temperature and water flow sensors indicate that a potentially harmful condition for water injection is present.

In certain embodiments, the electronic controller is configured to control a speed and a volume of water injection from the source aquifer to the target reservoir by driving the pump at a varying speed.

The electronic controller can be implemented using a processor, a communication mode, and memory storing instructions for enabling the processor to execute a water compatibility determination and to operate the electrically submersible pump with variable speed drive control.

Embodiments of the present invention further provide a method for artificially recharging a target reservoir in a geological formation having a first permeability using powered water injection from a source aquifer situated in a layer having a second permeability which is comparatively higher than the first permeability. The method comprises detecting at least a downhole pressure differential condition at an electrical submersible pump (ESP) positioned between target reservoir and the source aquifer in order to inject water from the source aquifer into the target reservoir, injecting water from the comparatively high permeability source aquifer to the comparatively low permeability target reservoir by activating the ESP, and controlling a rate at which the ESP injects water using at least the detected downhole pressure differential condition so as to maintain a prescribed pressure level in the target reservoir. The water is redistributed from the local source aquifer to the target reservoir to maintain the prescribed pressure level in the target reservoir.

In some implementations, the ESP is a centrifugal pump and the rate at which the ESP injects water is controlled by a variable speed drive.

Some embodiments of the method further comprise further detecting temperature and water flow rate conditions, determining from the detected downhole pressure differential, temperature and water flow rate whether a potentially harmful condition is present, and shutting down the ESP if it is determined that a potentially harmful condition is present.

The ESP can be positioned in a bore hole that extends to the target reservoir and source aquifer, with a control valve positioned in the bore hole between the source aquifer and target reservoir. In some implementations, the control valve is closed by a programmed system in response to a determination that a potentially harmful condition is present.

These and other aspects, features, and advantages can be appreciated from the following description of certain embodiments of the invention and the accompanying drawing figures and claims.

DETAILED DESCRIPTION OF CERTAIN EMBODIMENTS OF THE INVENTION

Disclosed herein is a system and method for artificially recharging a target reservoir using powered water injection from a local source. The system and method solve the problems of maintenance of fluid pressure at remote target reservoirs by injecting water from local aquifers having chemical compatibility with the target reservoir. At some oil and gas production sites, there are one or more aquifers containing an accessible volume of water ("source aquifers") located within the vicinity of a target reservoir. The source aquifers can be situated under rock layers at a position deeper than the target reservoir. Additionally or alternatively, the source reservoir can be situated in a layer (higher, lower or lateral) having relatively higher permeability than the target reservoir; water injection from the region of higher permeability can help elevate the pressure of the target reservoir which suffers from pressure loss due to having low permeability. An electrical submersible pump (ESP) is positioned between the source aquifer and the target reservoir. The ESP includes a plurality of sensors including temperature, pressure and chemical sensors, and a flow meter. The chemical sensors can be used to collect chemical data from the target reservoir and source aquifer, and to test whether there is chemical compatibility between the target reservoir and source aquifer, which is often the case when the target reservoir and source aquifer are located near each other in the same general geological formation. In addition, the pressure and temperature sensors of the ESP provide data for adjusting a variable speed drive (VSD) of the pump, and allow for controlled regulation (i.e., open loop or closed loop) of the speed and volume of water injection from the source aquifer to the target reservoir.

Figure 1:
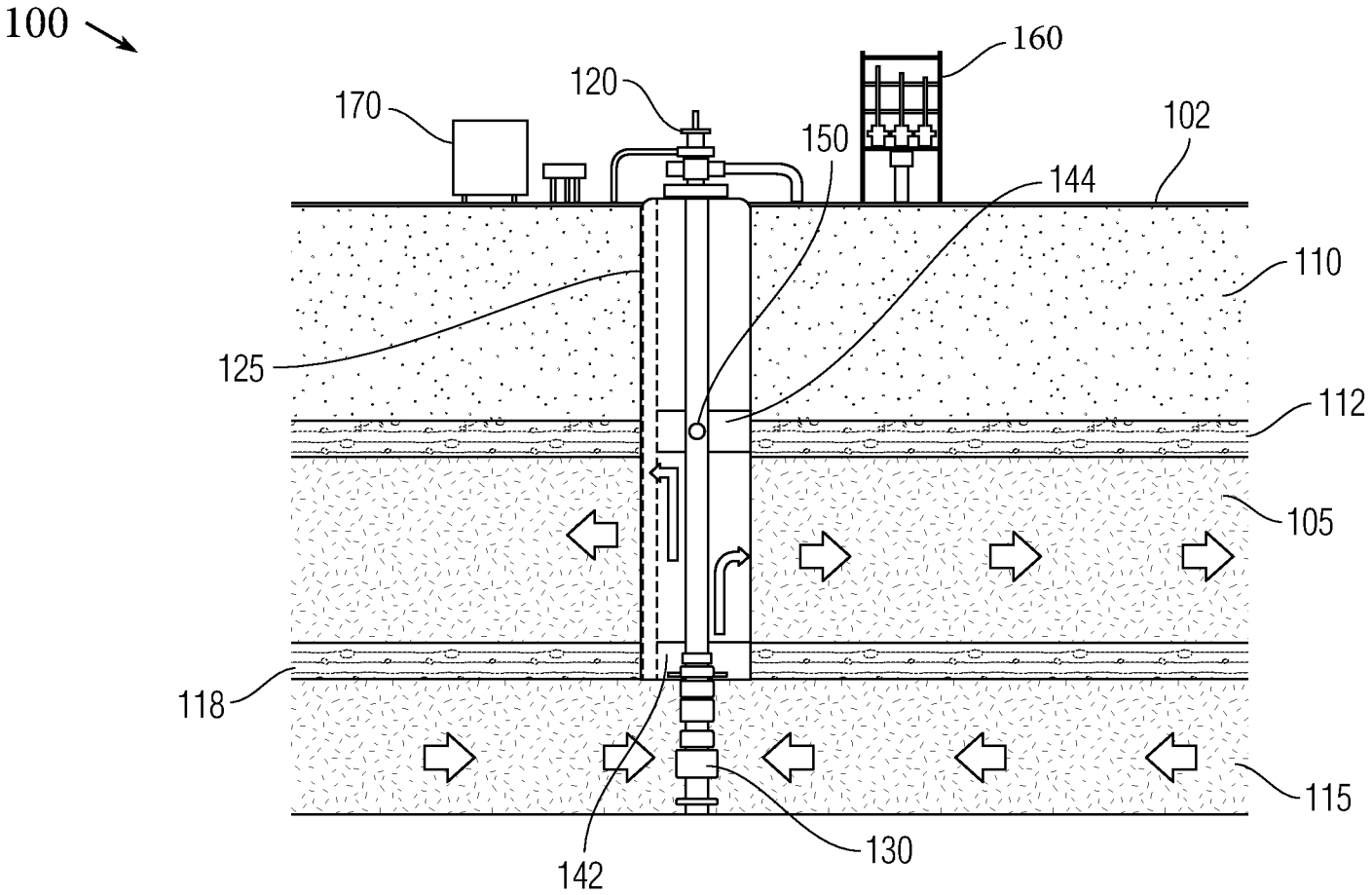
FIG. 1 is a cross-sectional view through an example geological formation including a source aquifer and a target reservoir in a system for artificially recharging a target reservoir using water injection according to an embodiment of the present invention is deployed.

FIG. 1 is a cross-sectional view through an example geological formation including a source aquifer and a target reservoir in which a system for artificial recharging of a target reservoir according to an embodiment of the present invention is deployed. The example geological formation 100 includes several strata or vertical layers. At some depth under the surface 102, is a target reservoir 105 for which it is desired to maintain fluid pressure in order to stimulate or support oil/gas fluid production from the reservoir to the surface. Between the surface 102 and the target reservoir 105 is a top stratum 110 which can be of variable depth. The target reservoir 105 is separated from the top stratum 110 by an impermeable geological layer 112. Positioned at a depth beneath the target reservoir 105 is a source aquifer 115 containing fluid (predominantly water) that is at a higher fluid pressure than the target reservoir 105. The source aquifer 115 is separated from the target reservoir by an impermeable geological layer 118. It is noted that while in the depicted formation, the source aquifer is situated deeper than the target reservoir, this is not necessarily the case in all formations to which the present invention can be applied. The source aquifer can be positioned above or even laterally with respect to the target reservoir (e.g., the source aquifer and target reservoir can be separated by a geological fault).

In order to inject fluid into the target reservoir a bore hole is drilled from the surface 102 through the top stratum 110 and target reservoir 105 to the source aquifer 115 (and the impermeable rock layers in between). The bore hole is capped by a well head 120. Within the bore hole a tubular cable housing 125 is inserted. The cable housing 125 extends from a proximal end at the surface 102 to a distal end at the top of the source aquifer 115. Within the internal space defined by the cable housing an electrical submersible pump (ESP) 130 and electrical power cable (not shown) is inserted (e.g., by wireline) and deployed at the distal end of the cable housing. The ESP 130, which is narrower than the cable housing 125, extends into the source aquifer 115. The ESP 130 can be implemented using centrifugal pump including a shaft and multiple stages with impellers and diffusers. The shat of the ESP 130 can be driven by a motor having variable speed drive capability.

A first annular packer 142 is positioned at the top of the ESP 130 within the cable housing approximately at the level of impermeable layer 118. A second annular packer 144 is positioned at the top of the target reservoir approximately at the level of impermeable layer 112. The packers can be elastomeric components that are flexible and expandable. The packers are lowered through cable housing to a particular vertical position. As they are positioned, the packers initially have an initial outside diameter that is smaller than the inner diameter of the cable housing. Upon reaching the position of deployment, the packers expand to the outer limits inner diameter of the cable housing, effectively sealing the bore hole at the vertical position at which they are deployed. Care is taken in the design and materials of the packers to prevent leaks. A control valve 150 is positioned at the level of the second packer 144 within the housing.

Components for controlling the ESP 130 and providing electrical power are positioned at the surface 102. A local power supply 160 provides electrical power for driving all electromechanical elements of the system. The local power supply can be a portable electric generator or a solar cell array installed at the production site. Electrical controller 170 receives power from the local power supply 160 and is electrically coupled to the ESP 130 through the cable housing 125. Electrical controller 170 includes a processor that is configured to transmit electrical signals for driving (energizing) and operating the operating the ESP 130 and to receive sensor data from the ESP. The controller 170 is configured to shut off power to the ESP if operating conditions, such as temperature or pressure, are not maintained. Controller 170 also is configured to operate the control valve 150. Furthermore, the controller is used to implement variable speed drive for the ESP.

The processor at the controller 170 executes an algorithm for operating the ESP with variable speed drive. The controller can reduce the pump speed depending on current conditions instead of relying upon conventional "pump on/pump off" operation. Reduction of the pump speed helps to maintain and maximize production while reducing energy consumption and mechanical stresses. The VSD responds to changes in torque, speed, viscosity flow, and downhole temperature and pressure changes, detected from ESP sensors downhole and from pump operation parameters detected directly by the controller, adjusting the pump rotation speed based on current conditions automatically. In addition, by receiving feedback from pump operation parameters and sensors, the controller can detect harmful conditions such as gas pockets (cavitation) that could cause the pump to accelerate to dangerously high speeds. When such conditions are detected, the VSD can slow the ESP to let the gas pass and then returns to normal speed. In general, implementation of variable speed drive for the ESP aids in streamlining injection contributions and in ensuring injection efficiency. Implementation of the VSD algorithm by the controller 170 also helps to regulate the production rate from the source aquifer for injection rate management across the target injected zone (over or under injection) and enables strategy optimization (i.e., tailoring water injection to maximize oil and gas production from the reservoir over time).

Figure 2A:
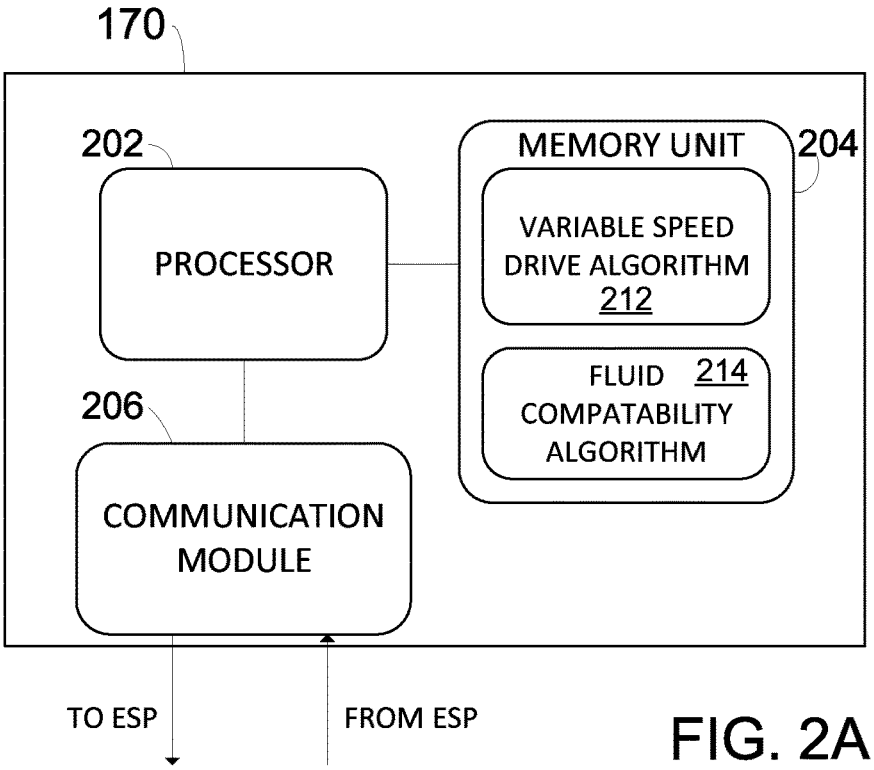
FIG. 2A is a schematic illustration of a controller of a system for artificially recharging a target reservoir according to an exemplary embodiment of the present invention.

FIG. 2A is a block diagram of a controller 170 that can be used in the context of the present invention. As shown the controller includes a processor 202, a memory unit 204, which can be implemented using solid-state memory or other memory devices, a communication module 206, and a power unit coupled to the local power supply 160. The memory unit stores algorithm instructions 212 for operating an ESP with a variable speed drive. The memory unit also stores instructions for analyzing signals received from downhole sensors coupled to the ESP to determine water compatibility. The communication module 206 is used to transmit command signals generated by the processor 202 for operating the motor driving the ESP, and also to receive sensor signals from the ESP, which are then transmitted to the processor. The controller 170 is operative to adjust, shut-down or start-up operation of the ESP based on the sensor signals.

Figure 2B:
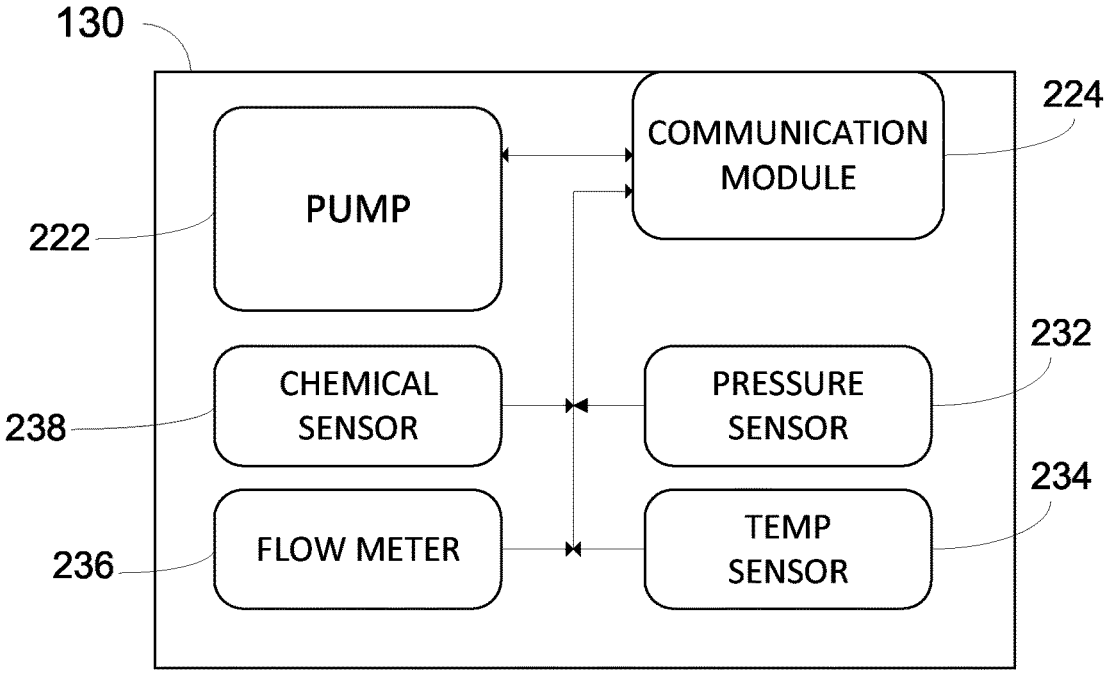
FIG. 2B is schematic illustration of an electrically submersible pump (ESP) of a system for artificially recharging a target reservoir according to an exemplary embodiment of the present invention.

FIG. 2B is a block diagram of an electrical submersible pump (ESP) 130 according to an embodiment of the present invention. The ESP 130 includes a pump 222, a communications module 224, and several sensors such as, but not limited to, a pressure sensor 232, a temperature sensor 234, a flow rate meter 236 and a chemical sensor 238. These elements are enclosed in or attached to a housing as shown in FIG. 1. Data acquired by the sensors 232, 234, 236, 238 is delivered to the communication module 224, and from there to the controller 170 for processing and analysis. In addition, the ESP 130 receives command signals from the controller 170 via communication module 224. The pressure sensor 232 of the ESP 130 can detect pressure differentials, and, more particularly, a pressure differential acting along the axis of the ESP, for example, between the source aquifer and the target reservoir.

Figure 3:
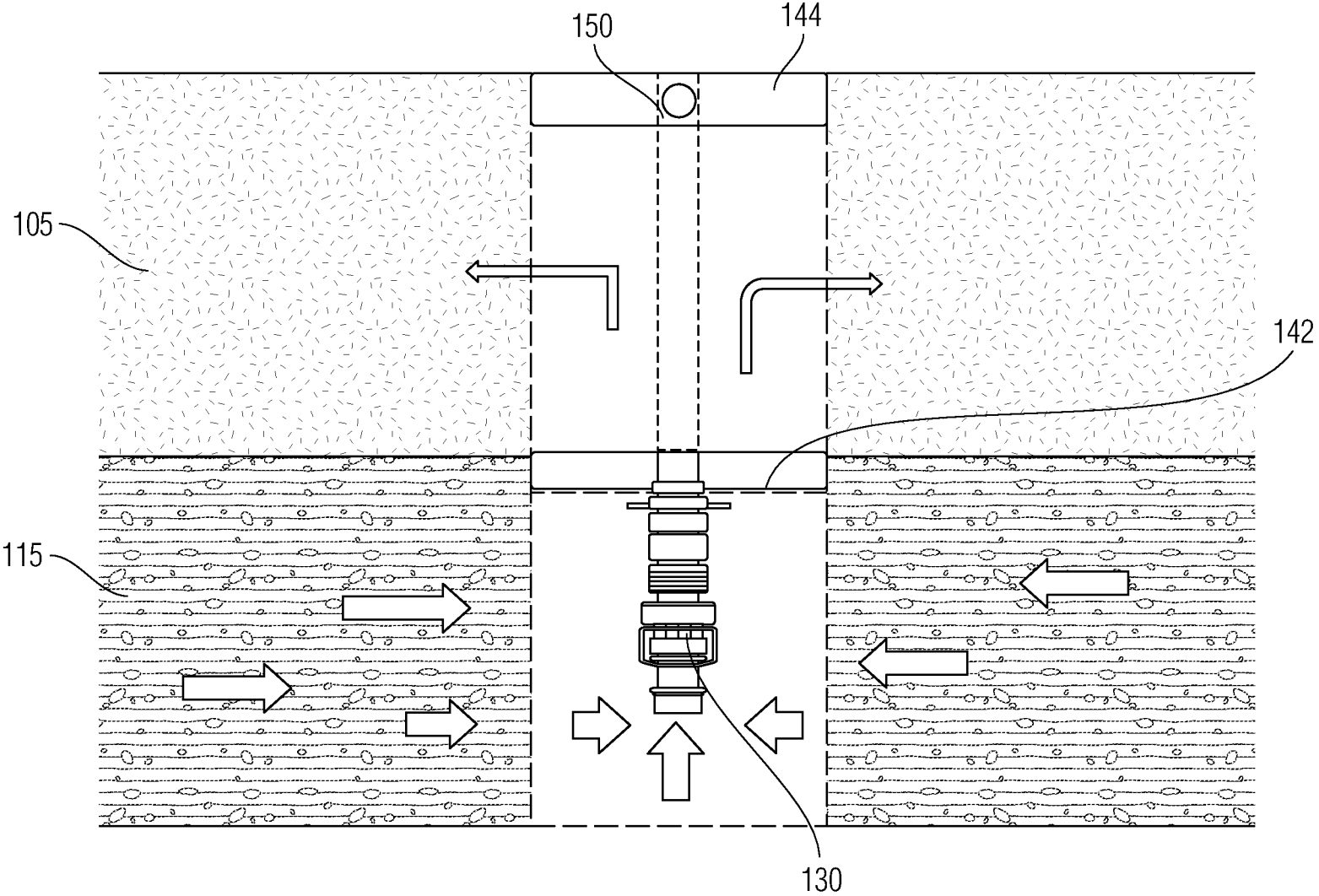
FIG. 3 is an enlarged view of the bottom portion of FIG. 1.

FIG. 3 is an enlarged view of the bottom portion of FIG. 1 illustrating the ESP, the source aquifer and the target reservoir. In FIG. 2, arrows are shown illustrating the direction of fluid flow both into and out of the ESP 130 during operation. The ESP 130 is attached to tubing 305 that extends upwardly from the ESP within the cable housing 125 and through packers 142, 144 to the level of the target reservoir 115. The walls of tubing 305 include perforations e.g., 307, 309 that permit fluid drawn by the pump out of the tubing. The control value 150 is positioned within tubing 305 at the level of packer 144. As shown, fluid in the source aquifer 115, at elevated pressure, is drawn by the pumping action of the ESP through perforations e.g., 312, 314 in the wall of the cable housing and into an opening 310 at the bottom of the ESP. The ESP pumps the fluid at elevated pressure from source aquifer 115 upwards to the level of the target reservoir 105. The pressurized fluid flows outwardly from openings in the ESP and perforations e.g., 322, 324 in the cable housing into the target reservoir 115. During fluid injection, the controller 170 sends command signals to keep the control valve 150 closed. The combination of the closed control valve and the packer 144 prevent injected fluid from flowing upwardly within the cable housing and aid in forcing the fluid laterally through the perforations 312, 314 and into the pressure-depleted target reservoir. The pressurized fluid injected into the reservoir by the ESP increase the fluid pressure within the target reservoir 115 to levels required for oil and gas production.

Figure 4:
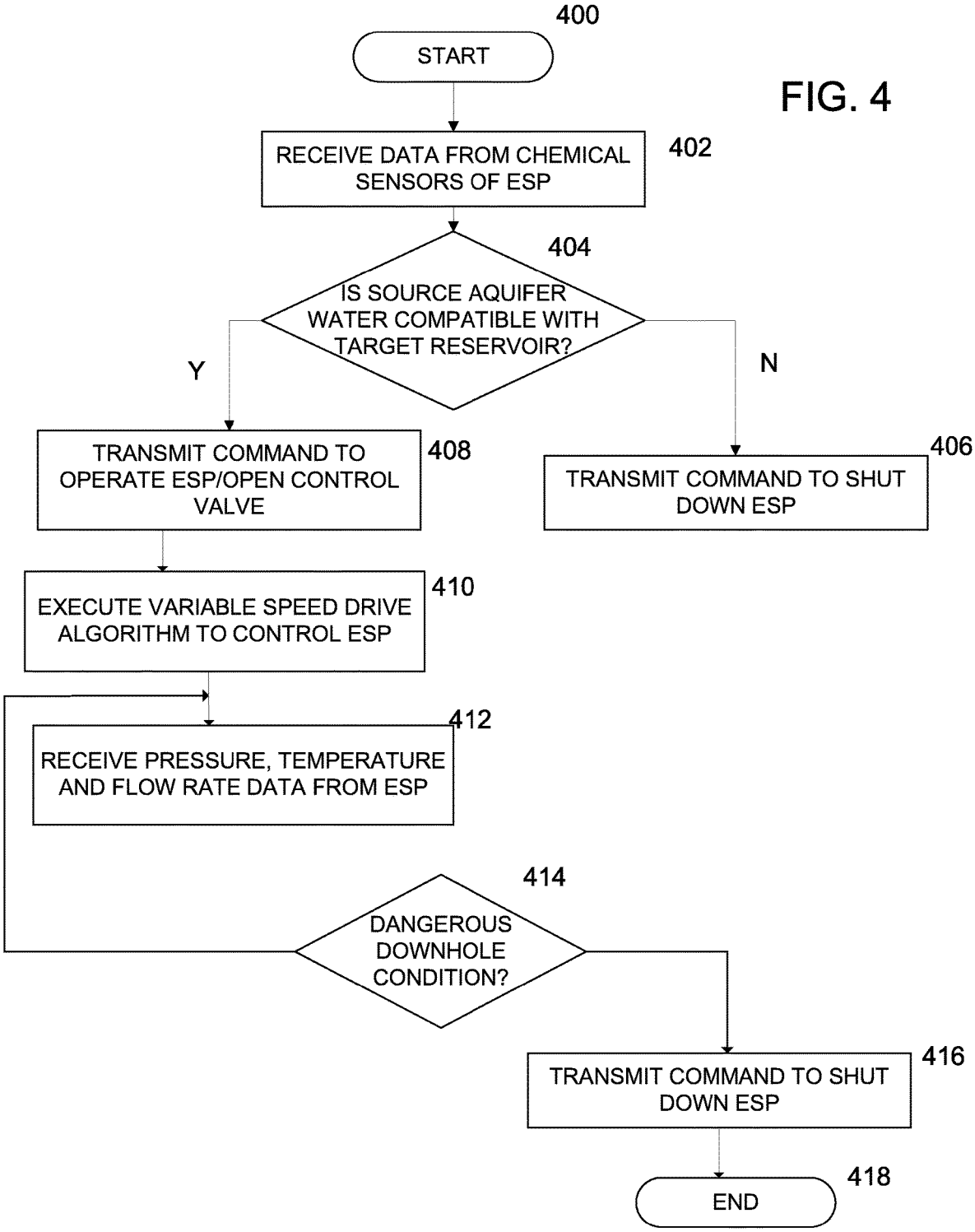
FIG. 4 is a flow chart of a method of artificially recharging a target reservoir using water injection from a local source according to an embodiment of the present invention

FIG. 4 is a flow chart of a method for artificially recharging a target reservoir using powered water injection from a local source according to an embodiment of the present invention. The method begins in step 400. In step 402, the controller receives data from the chemical sensors of the ESP that provides information about the chemical composition water within of the source aquifer. The controller also obtains data regarding the known chemical composition of the water in the target reservoir. In step 404, the controller executes an algorithm for determining the compatibility of the target reservoir by comparing the known composition of the target reservoir with the chemical composition of the source aquifer interpreted from the chemical sensor data. Chemical compatibility is an important concern in oil production. Mixing water from different sources that have different ionic content can result in the precipitation of minerals, and the deposition of solids (scaling) in the target reservoir. Mineral deposition and scaling damages the target reservoir and can reduce production rates. If it is determined that the water in the source aquifer and the target reservoir water are not chemically compatible, then in step 406, the controller transmits signals to the ESP to close shut down the pump and close the control valve 150. If it is determined that the water in the source aquifer is chemically compatible with the water in the target reservoir, then in step 408, the controller transmits signals to the ESP to activate the pump and open the control valve, permitting water to be injected from the source aquifer into the target reservoir. In step 410, following step 408, the controller executes the variable speed drive algorithm to control the speed of the pump, control water injection flow rates. In step 412 the controller receives pressure, temperature and flow rate sensor data from the ESP. In step 414, the VSD algorithm analysis the received sensor data and determines whether a potentially harmful downhole condition exists. If a harmful condition exits, in step 416, the controller transmits a signal to shut down the ESP and close the control valve and the method ends in step 418; if a harmful condition does not exist, the method cycles back to step 412 in a continues to monitor conditions in a control loop.

In some embodiments of the recharging method, such as embodiments particularly suited for those geological formations in which the source aquifer has higher permeability than the target reservoir and the target reservoir and source aquifer and are known to be chemically compatible, water compatibility is not a condition upon which injection depends. In such embodiments, if a pressure differential between the target reservoir (e.g., at a threshold level) is detected, the ESP injects water from the higher permeability source aquifer to the target reservoir. The rate at which the ESP injects water is controlled based on the difference in pressure between the source aquifer and target reservoir so as to maintain a prescribe pressure level in the target reservoir. During this process, water is redistributed from the source aquifer to the target reservoir to maintain the prescribed pressure in the target reservoir.

Embodiments of the present invention provide a number of benefits in comparison with conventional water injection systems and methods. By using local and compatible water sources, formation damage is reduced relative to external water injection from sea water or shallow aquifers. Reduced formation damage in turn reduces casing leaks and corrosion. Costs are optimized by avoiding construction of extensive infrastructure, such as pipelines, that would be needed to accommodate external water injection. Additionally, the costs of upgrading water injection systems in marginal oilfields is reduced. Well longevity and reliability are promoted by improved to downhole data availability and adaptable water injection flow rates through variable speed regulation. Moreover, by digitization and real-time monitoring of pressure, temperature and flow rate data, current downhole conditions that be accurately assessed, and thereby downhole injection rate and pressure can be maximized based on the current conditions. Alternatively, the injection rate can be flexibly adjusted to meet a target injection production ratio (IPR) based on monitored downhole conditions. Another benefit of utilization of local source aquifers is that shallow aquifers that might otherwise be tapped for external water injection can be preserved. It is to be understood that any structural and functional details disclosed herein are not to be interpreted as limiting the systems and methods, but rather are provided as a representative embodiment and/or arrangement for teaching one skilled in the art one or more ways to implement the methods.

It is to be further understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing, and are not to be construed as limiting. However, it is recognized these terms could be used with reference to a viewer. Accordingly, no limitations are implied or to be inferred.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for artificially recharging a target reservoir in a geological formation using powered water injection from a local source aquifer in the geological formation, comprising:

detecting chemical properties of water in the source aquifer;

determining whether the water in the source aquifer is compatible with water in the target reservoir based on the chemical properties;

activating an electrical submersible pump (ESP) positioned between target reservoir and the source aquifer to inject water from the source aquifer into the target reservoir once it is determined that the water in the source aquifer is compatible with water in target reservoir based on the chemical properties;

detecting downhole pressure, temperature and water flow rate conditions at the ESP; and controlling a rate at which the ESP injects water using the detected downhole pressure, temperature and water flow rate conditions.

2. The method of claim 1, wherein the ESP is a centrifugal pump and the rate at which the ESP injects water is controlled by a variable speed drive.

3. The method of claim 1, further comprising:

determining from the detected downhole pressure, temperature and water flow rate whether a potentially harmful condition is present; and shutting down the ESP if it is determined that a potentially harmful condition is present.

4. The method of claim 3, wherein the ESP is positioned in a bore hole that extends to the target reservoir and source aquifer and a control valve is positioned in the bore hole between the source aquifer and target reservoir.

5. The method of claim 4, further comprising the step of closing the control valve if is determined that a potentially harmful condition is present.

6. A system for artificially recharging a target reservoir in a geological formation using powered water injection from a local source aquifer in the geological formation, comprising:

an electrical submersible pump (ESP) positioned between the target reservoir and the source aquifer, the ESP including a pump and a plurality of sensors, the plurality of sensors having a chemical sensor adapted to detect chemical properties of water in the source aquifer, and at least one downhole condition sensor; and an electronic controller electrically coupled to the electrically submersible pump configured to receive data from plurality of sensors, to determine whether the water in the source aquifer is compatible with the water in the target reservoir, and to activate the pump to inject water from the source aquifer into the target reservoir once it is determined that the water in the source aquifer is compatible with water in target reservoir based on the chemical properties and downhole conditions are amenable for water injection.

7. The system of claim 6, further comprising a cable conduit positioned in a bore hole connecting the target reservoir and the source aquifer, the ESP being positioned in the cable conduit, the cable conduit having wall perforations permitting water to exit the conduit into the target reservoir.

8. The system of claim 7, further comprising a control valve positioned in the cable conduit between the source aquifer and the target reservoir electrically coupled to and re responsive to control signals from the electronic controller.

9. The system of claim 8, wherein the at least one downhole condition sensors includes a pressure sensor, a temperature sensor and a water flow meter.

10. The system of claim 9, wherein the electronic controller is configured to shut down the pump of the ESP and the control value if data received from the pressure, temperature and water flow sensors indicate that a potentially harmful condition for water injection is present.

11. The system of claim 6, wherein the electronic controller is configured to control a speed and a volume of water injection from the source aquifer to the target reservoir by driving the pump at a varying speed.

12. The system of claim 6, wherein the electronic controller includes a processor, a communication mode, and memory storing instructions for enabling the processor to execute a water compatibility determination and to operate the electrically submersible pump with variable speed drive control.

13. A method for artificially recharging a target reservoir in a geological formation having a first permeability using powered water injection from a source aquifer situated in a layer having a second permeability which is comparatively higher than the first permeability, comprising:

detecting at least a downhole pressure differential condition at an electrical submersible pump (ESP) positioned between target reservoir and the source aquifer in order to inject water from the source aquifer into the target reservoir;

injecting water from the comparatively high permeability source aquifer to the comparatively low permeability target reservoir by activating the ESP; and controlling a rate at which the ESP injects water using at least the detected downhole pressure differential condition so as to maintain a prescribed pressure level in the target reservoir, whereby water is redistributed from the local source aquifer to the target reservoir to maintain the prescribed pressure level in the target reservoir.

14. The method of claim 13, wherein the ESP is a centrifugal pump and the rate at which the ESP injects water is controlled by a variable speed drive.

15. The method of claim 13, further comprising:

further detecting temperature and water flow rate conditions, determining from the detected downhole pressure differential, temperature and water flow rate whether a potentially harmful condition is present; and shutting down the ESP if it is determined that a potentially harmful condition is present.

16. The method of claim 15, wherein the ESP is positioned in a bore hole that extends to the target reservoir and source aquifer and a control valve is positioned in the bore hole between the source aquifer and target reservoir.

17. The method of claim 16, further comprising the step of closing the control valve if is determined that a potentially harmful condition is present.

* * * * *